United States Patent [19]

Karkow

[11] Patent Number: 4,956,524

[45] Date of Patent: Sep. 11, 1990

[54] WOVEN ELECTRICAL TRANSMISSION CABLE

[75] Inventor: Edward E. Karkow, Glen Arm, Md.

[73] Assignee: GSI Corporation, Timonium, Md.

[21] Appl. No.: 346,586

[22] Filed: May 2, 1989

[51] Int. Cl.[5] ..... H01B 7/08

[52] U.S. Cl. ..... 174/117 M; 139/425 R

[58] Field of Search ..... 174/117 M; 139/425 R

[56] References Cited

U.S. PATENT DOCUMENTS

| | | | |
|---|---|---|---|
| 1,696,402 | 12/1928 | Horton | 174/117 M |
| 3,582,537 | 6/1971 | Perreault | 174/117 M |
| 4,143,236 | 3/1979 | Ross et al. | 174/117 M X |
| 4,460,803 | 7/1984 | Piper | 174/117 M X |
| 4,463,323 | 7/1984 | Piper | 174/117 M X |
| 4,527,135 | 7/1985 | Piper | 174/117 M X |
| 4,746,769 | 5/1988 | Piper | 139/425 R X |

*Primary Examiner*—Morris H. Nimmo

*Attorney, Agent, or Firm*—Bacon & Thomas

[57] ABSTRACT

A woven electrical transmission cable includes a plurality of longitudinally extending conductor and ground wires which are substantially parallel with one another. These conductor and ground wires are woven together with a number of insulating fiber strands to define a woven pattern wherein the conductor and ground wires define an undulating shape. The amplitude and frequency of the respective undulations are approximately equal if not equal. The woven cable also includes a longitudinally extending warp member at each edge thereof which has a breaking strength which is at least twenty (20) times and preferably fifty (50) times the breaking strength of a conductor or ground wire.

14 Claims, 4 Drawing Sheets

WOVEN ELECTRICAL TRANSMISSION CABLE

BACKGROUND OF THE INVENTION

This invention relates to flat woven electrical transmission cables having a plurality of conductors and more particularly to flat woven cable made of fine wire and thread, and designed to deliver matched or controlled impedance.

Flat woven impedance cable is indispensable for a number of applications. For example, such cable, which includes a pair of longitudinal ground wires carried between adjacent conductor wires in a substantially parallel relationship with the conductor wires, is disclosed in the U.S. Pat. No. 4,143,236 of Ross et al. Such cables have reduced cross-talk interference and a controlled impedance providing uniform signal propagation.

However, an increased demand for size reductions in such cable has led to a high incidence of mechanical failure. For example, such failure or breakdown frequently occurs in those areas where these cables are handled, installed and/or flexed in use: (1) at the outside edges where the solid copper conductors are subjected to unsustainable angular forces; (2) at the terminal connector end where the conductors must flex while at the same time sustaining a pulling force; and (3) at any place in the cable where the cable must be bent through a small radius from 90° to 180° and then back to its original position.

Efforts to correct the problems at the connector end have included potted and epoxy-filled backshells and clamping pressure from molded backshells. In addition, a variety of jacket designs has been used in an attempt to overcome the problems. However, improved connectors will not prevent breakdowns which are caused by the cable being bent through a small radius and then back to its original position and may not fully protect the cable from other types of failure.

SUMMARY OF THE INVENTION

In essence, a woven electrical transmission cable according to the present invention provides controlled impedance and includes a plurality of longitudinal conductor wires arranged in a substantially side by side relationship for transmitting signals. The cable also includes a plurality of longitudinal ground wires which are substantially parallel to the conductor wires and disposed between the conductor wires. Insulating fiber strands are interwoven with the conductor and ground wires to define a woven pattern wherein the conductor and ground wires define or have an undulating shape and wherein the undulations of the conductor and ground wires are approximately equal. Each side of the cable may also include a longitudinally extending warp member of high strength fiber woven into the cable to thereby form the selvage thereof. This warp member has a breaking strength of at least 20 times and preferably 50 times the breaking strength of a conductor or ground wire and is adapted to anchor the cable to an electrical connector.

According to a preferred embodiment of the invention, a pair of longitudinal ground wires is provided between next adjacent conductor wires to provide an independently associated ground wire on each side of each conductor wire to thereby electrically insulate each conductor wire. The undulations of the conductor and ground wires may be in phase or out of phase with each other and with adjacent sets of conductors and ground wires, all of which are of equal length and may be separated from each other by one or more insulating fiber strands.

BRIEF DESCRIPTION OF THE DRAWINGS

The invention will now be described in connection with the accompanying drawings, wherein:

FIG. 3 is an expanded plan view illustrating a woven electrical transmission cable according to a preferred embodiment of the invention;

DETAILED DESCRIPTION OF THE INVENTION

Figure 1:
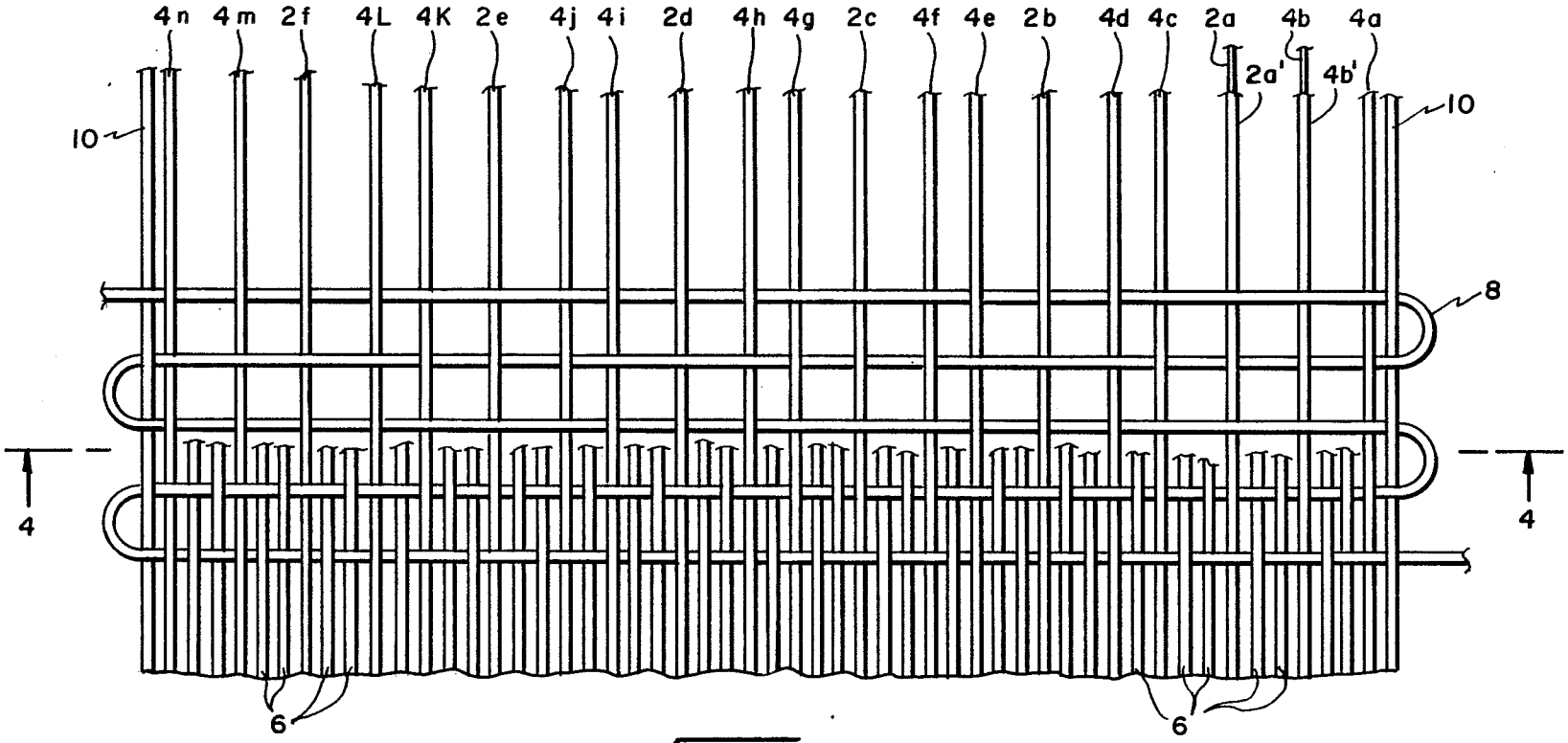
FIG. 1 is an expanded plan view illustrating a woven electrical transmission cable according to a first embodiment of the invention.
Figure 4:
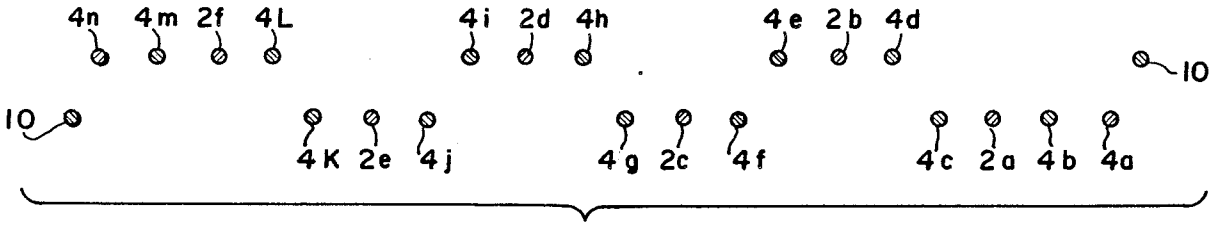
FIG. 4 is a schematic diagram illustrating the geometrical configuration of the conductor and ground wires of a woven electrical transmission cable constructed in accordance with the first embodiment of the invention taken along the lines 4—4 of FIG. 1.

A woven electrical transmission cable according to a first embodiment of the invention is illustrated in FIGS. 1 and 4 wherein a plurality of longitudinally extending conductor wires 2*a* through 2*f* are arranged in a substantially side by side relationship for transmitting electrical signals. The conductors 2*a*–2*f* are preferably insulated with a thin coating or extrudate of polyurethane/polyamide or the like as will be well understood by those skilled in the art and as shown by 2*a*′ in FIG. 1.

A plurality of longitudinally extending ground wires 4*a* through 4*n* are arranged in a substantially side by side relationship with the conductor wires 2*a* through 2*f* to insulate the conductor wires 2*a* through 2*f* from spurious signals. For example, each conductor wire 2*a* through 2*f* has a pair of ground wires such as 4*b* and 4*c* on each side thereof. Thus, an independently associated ground wire 4 is provided on each side of each conductor. Such ground wires 4 are also preferably insulated with a thin polyurethane/polyamide coating as shown by 4*b*′ in FIG. 1.

In the second embodiment of the invention, the woven electrical transmission cable is woven by conventional loom programming in order that the conductor wires 2*a* through 2*f* and ground wires 4*a* through 4*n* have an undulating or sinusoidal shape along the length of the cable. In addition, both conductor and ground wires, whether in-phase or out-of-phase, define essentially the same path and are of identical length throughout the length of the cable. As a result the amplitudes of the undulations are approximately equal if not equal. For example, the undulation of the conductor wires 2 and ground wires 4 as illustrated in FIGS. 1 and 4 are in-phase, i.e., they are parallel with each other and of identical lengths.

In the woven cables according to the present invention, the ground wires mimic the undulations of the signal wires unlike the prior art cables wherein the ground wires describe a straight path through the cable or undulate at a different amplitude than the undulations of the signal wires. A principal benefit of this feature is that when the cable is bent, all of the wires are placed under equal stress. Thus, when the cable is straightened or returned to its original position, all of the wires are returned to their original positions and none are left protruding as occurs in prior art designs.

The conductor wires 2 and ground wires 4 are interwoven with insulating fiber warp strands 6 and weft strands 8 which define a woven pattern having a substantially flat configuration. Only a short length of the warp strands are shown for clarity. The warp strands 6 and weft strands 8 may, for example, consist of a non-melting aromatic polyamid material such as a plurality of extremely fine Nomex (E. I. duPont trademark) strands which form a yarn or bundle of strands of about 200/3 denier.

The properties of the Nomex aramid yarn which was incorporated in the presently preferred embodiment of the invention are set forth in a duPont Product Date Sheet identified by "Description 200-100-430", dated Aug. 1, 1987. However, it should be recognized that other fibrous insulating yarns or materials may be used as will be well understood by those who are skilled in the art.

In the woven pattern, the lateral spacing between the exclusive ground wire pairs and their respective conductor wires is fixed and determines the impedance of each conductor wire. For example, in the embodiments of the invention as illustrated in FIGS. 1–6, the ground wires 4 are separated from the conductor or signal wires 2 by at least two insulating warp strands 6. Next adjacent ground wires such as **4*b* and 4*c* and/or 4*a* and 4*b* are also separated from one another by two warp strands 6. The spacings between the conductor wires 2 and ground wires 4 by insulating woven warp strands 6 are illustrated in FIG. 1** and further described hereinafter.

In the first embodiment, as illustrated in FIG. 1, two pairs of insulating woven warp strands 6, two ground wires 4 and at least one insulating woven warp strand 6 between adjacent ground wires 4 separate adjacent conductor wires 2 and are held in place together with the conductor wires 2 and ground wires 4 by the weft strands 8. The weft strands 8 are also made of a plurality of extremely fine Nomex strands or threads and have about the same thickness as the warp strands 6.

A longitudinally extending aramid fibrous member 10 having a breaking strength which is at least twenty (20) times and preferably fifty (50) times the breaking strength of each of the conductors is provided at the selvages of the cable. These members 10 also have substantially higher modules of elasticity than that of the conductor and are located laterally outwardly from and arranged one on either side of the cable. Each of the members 10 is adapted for being connected to an electrical connector (not shown) so that substantially all of a lateral load applied to a connector member (not shown) or a load applied to the cable assembly will be transmitted to the connector member through the fibrous members 10. A more complete description of a connector assembly using the woven cables described herein is defined in a copending U.S. patent application of John Douglas Sainsbury and Edward Karkow entitled "Strain Relief System for Connecting Cables" Ser. No. 320,423, filed on Mar. 8, 1989 and incorporated herein in its entirety by reference.

The longitudinally extending aramid fibrous members 10 are woven into the cable and held in place at the selvages by the weft strand 8 as will be well understood by a person of ordinary skill in the art of woven electrical cables.

The longitudinally extending aramid fibrous members 10 may be made of any aromatic polyamide fiber but are preferably made of Kevlar 29 Type 961 (trademark by duPont). The member 10 comprises a mass of fibrous strands with a denier of the mass of about 3,000 and a breaking strength of about 150 pounds. The fibrous members 10, which can be referred to as yarn, have a nominal modulus of about 570 g/d as compared to a nominal modulus of about 118 g/d for the Nomex. The properties of the Kevlar 29 aramid yarn are specified in a duPont Product Data Sheet Description 1500-1000-0-901, dated May 12, 1987.

The breaking strength of about 150 pounds for the longitudinally extending aramid fibrous members 10 compares favorably with a breaking strength of about three pounds for each of the conductor and ground wires 2 and 4, respectively, and to about 2.16 pounds for the Nomex fill strands 6. These wires 2 and 4 comprise a copper conductor of about 33 gauge with an insulation of about 0.0011 inch thickness of polyurethane/polyamide, polyethylene or the like. Thus, the outside diameter of the insulated conductor is about 0.0085 inches which provides a woven cable having a total thickness of about 0.06 inches. In practice of the invention, a typical woven cable having 26 conductors and 54 ground wires will have a width of 1.50 inches.

It should be understood that the present invention is particularly applicable to very thin cables with relatively fine wires for use in computers or the like where space and weight, as well as reliability, are critical factors. Such cable can be defined as having N conductor wires and 2N+2 ground wires where N is an integer between 10 and 50, a width of from 0.50 to 3.00 inches and a thickness which does not exceed 0.10 inches.

A complete cross-section of the cable according to the preferred embodiment of the invention can be defined with respect to the longitudinal elements as follows:

K g ww g ww S ww g w g ww S ww g w g ww S
ww g w g ww S ww g w g ww S ww g w g ww S
ww g ww g K wherein K indicates the aramid fibrous members, g the ground wires, S the conductor of signal wires and w the warp strands. As illustrated, there are two warp strands separating the conductor wires from adjacent ground wires and a single warp strand separating adjacent ground wires in the center of the cable, and two warp strands separating adjacent conductors at each edge of the cable.

Figure 2:
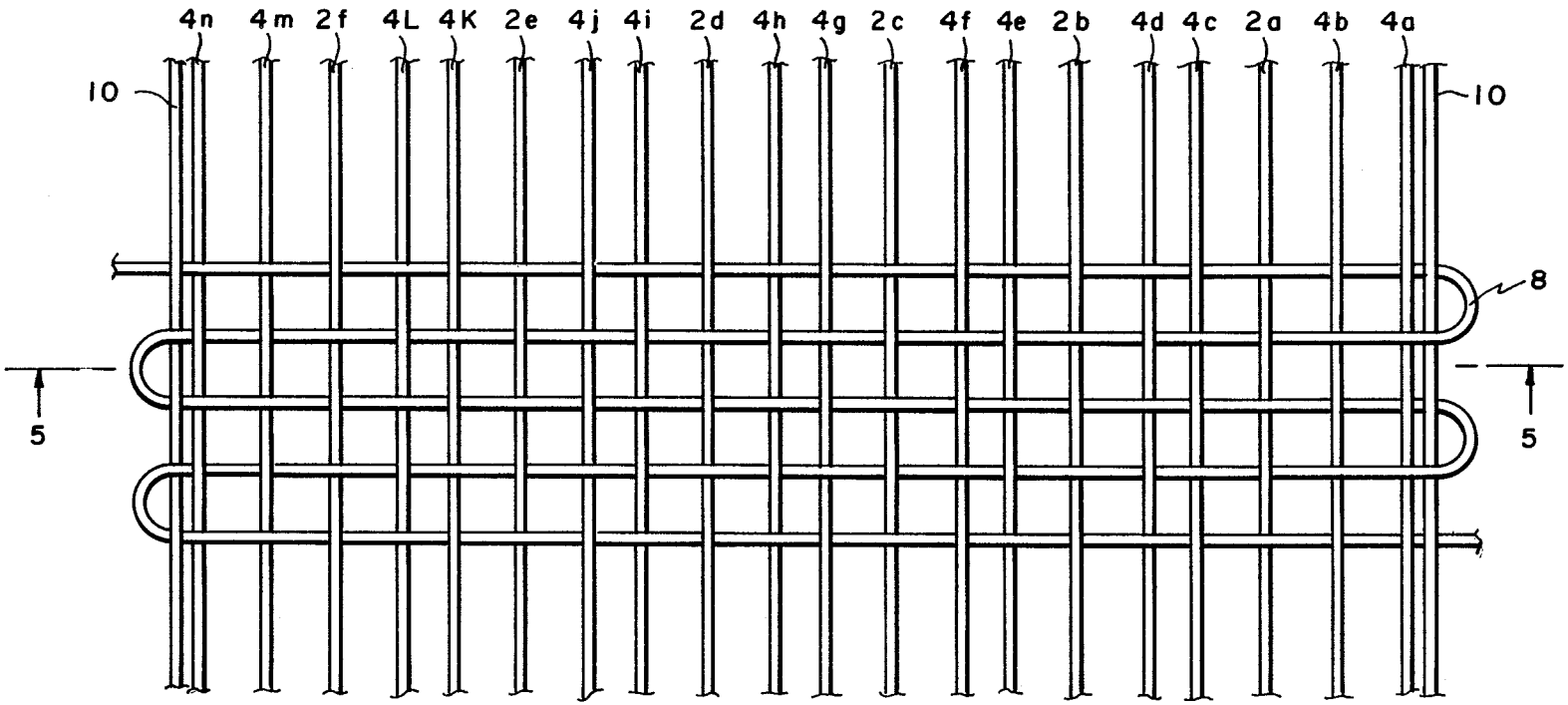
FIG. 2 is an expanded plan view illustrating a woven electrical transmission cable according to a second embodiment of the invention.
Figure 9:
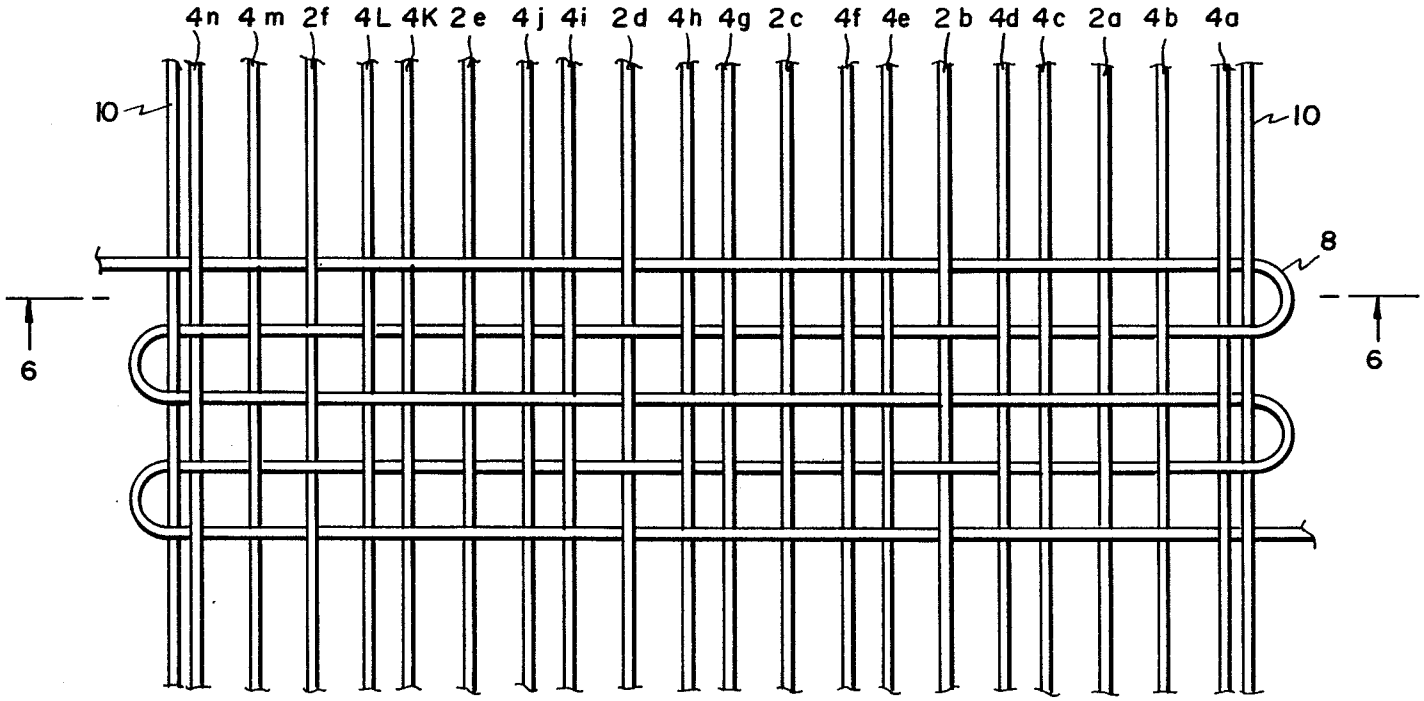

The aforementioned description is illustrated in FIG. 1 but applies equally to FIGS. 2 and 3. For example, each of the illustrated embodiments may be made with the same sequence of ground, conductor and woven insulating warp yarns. However, the in-phase, out of phase and alternate phases of the conductors and ground wires is illustrated in the figures. For example, FIGS. 1 and 4 illustrate a woven cable wherein the undulations, i.e., the amplitude peaks of the ground wire, are equal to and in-phase with the undulations of the conductor or signal wires.

Figure 5:
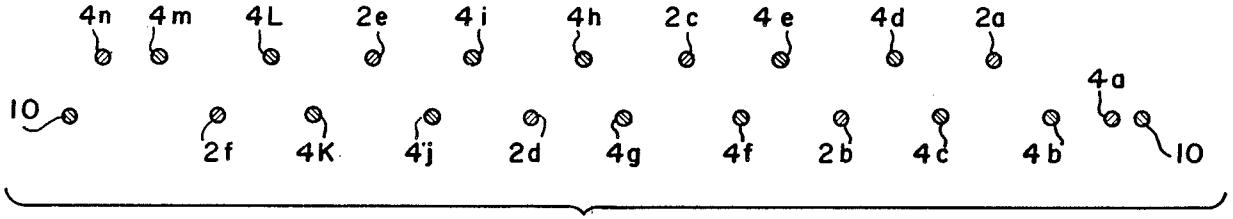
FIG. 5 is a schematic diagram illustrating the geometrical configuration of the conductor and ground wires of a woven electrical transmission cable constructed in accordance with the second embodiment of the invention taken along the lines 5—5 of FIG. 2.

The second embodiment of the invention is illustrated in FIGS. 2 and 5 wherein like numerals have been used to designate like elements. In this embodiment, the length of the conductor wires 2 and ground wires 4 are equal, but the undulation of the ground wires 4 are 180 degrees out of phase with the undulation of an associated conductor 2. The length of the conductor wires 2 and ground wires 4 are the same because their respective amplitudes and frequencies are equal or very close to being equal.

Figure 6:
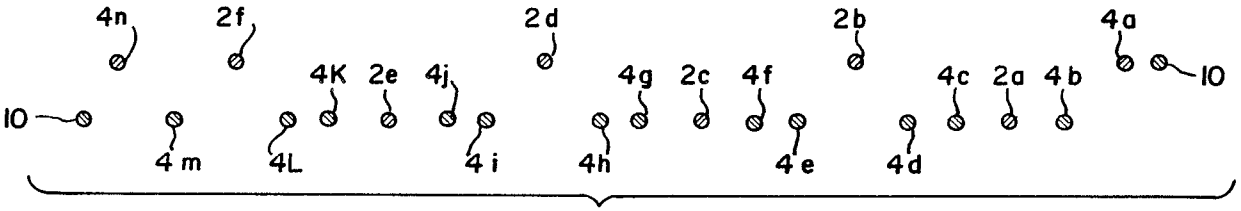
FIG. 6 is a schematic diagram illustrating the geometrical configuration of the conductor and ground wires of a woven electrical transmission cable constructed in accordance with the preferred embodiment of the invention taken along the lines of 5—5 of FIG. 3.

FIGS. 3 and 6 illustrate a preferred embodiment of the invention wherein the undulations of the ground wires are alternatively in phase and out of phase with the signal wires. As illustrated, the in phase and out of phase configuration is alternated across the width of the cable. In addition, the numbers of fibers longitudinally extending woven insulating members separating adjacent ground wires is different at the edge of the cable and at its center. For example, a cable as illustrated in FIG. 3 has a single insulating member between adjacent ground wires at its center and a pair of insulating yarn members between adjacent ground wires at the edge of the cable. In FIGS. 3 and 6 as in the other figures, only six signal wires are shown. However, a typical cable would include from 10 to 50 signal wires.

While the preferred embodiments of the invention have been described herein, it is to be understood that alternatives and modifications may be made without departing from the scope of the appended claims.

What is claimed is:

1. A woven electrical transmission cable having controlled impedance comprising:

a plurality of longitudinal conductor wires arranged in a substantially side by side relationship for transmitting signals;

a plurality of longitudinal ground wires coextending in a substantially parallel relationship with said conductor wires and separating said conductor wires;

insulating fiber strands interwoven with said conductor wires and said ground wires to define a woven pattern;

said woven pattern including said insulating fiber strands woven in the warp and filling directions and said conductor wires and said ground wires woven in said woven pattern to have an undulating shape with the same number of undulations in said conductor wires as in said ground wires so that said conductor wires and associated said ground wires define essentially the same path and the lengths of the conductor wires and ground wires are equal; and a selvage on each side of said cable.

2. A woven electrical transmission cable according to claim 1 in which the undulations of a pair of ground wires are in phase with the corresponding conductor wire for about one-half of the signal wires in the cable, and out of phase with about one-half of the conductor wires in the cable and wherein the in phase and out of phase configurations alternate across the cable.

3. A woven electrical transmission cable having controlled impedance comprising:

a plurality of longitudinal conductor wires arranged in a substantially side by side relationship for transmitting signals;

a plurality of longitudinal ground wires coextending in a substantially parallel relationship with said conductor wires and separating said conductor wires;

insulating fiber strands interwoven with said conductor wires and said ground wires to define a woven pattern;

said woven pattern including said insulating fiber strands woven in the warp and filling directions and said conductor wires and said ground wires woven in said woven pattern to have an undulating shape with the same number of undulations in said conductor wires as in said ground wires so that the lengths of the conductor wires and ground wires are equal and there undulations are parallel and in phase; and selvage on each side of said cable.

4. A woven electrical transmission cable according to claim 3 in which the plurality of longitudinal ground wires includes a pair of ground wires carried between next adjacent conductors providing an independently associated ground wire on each side of each respective conductor wire to isolate each said conductor wire.

5. A woven electrical transmission cable according to claim 3 in which said selvage on each side of said cable includes a longitudinally extending aramid fibrous member having a breaking strength which is at least twenty (20) times the breaking strength of a conductor or ground wire.

6. A woven electrical transmission cable according to claim 5 wherein each of the longitudinally extending aramid fibrous members has a breaking strength which is at least fifty (50) times the breaking strength of a conductor or ground wire.

7. A woven electrical transmission cable according to claim 6 wherein each of said conductor wires and said ground wires is insulated and has a breaking strength of about three (3) pounds, and wherein each of the aramid fibrous members has a breaking strength of from seventy-five (75) to one hundred fifty (150) pounds.

8. A woven electrical transmission cable according to claim 5 in which said insulating fiber strands are of a nonmelting aromatic polyamid material and in which said strands extending in the warp direction separate adjacent ground wires.

9. A woven electrical transmission cable according to claim 8 in which one of said ground wires is disposed on each side of said conductor wires and adjacent thereto.

10. A woven electrical transmission cable according to claim 9 which includes a second ground wire on each side of the cable between said selvage and one of said ground wires that is adjacent to a conductor wire.

11. A woven electrical transmission cable according to claim 10 in which said second ground wires are separated from said selvages and the next ground wires by longitudinally extending fiber strands of an aromatic polyamid material.

12. A woven electrical transmission cable according to claim 11 in which the number of conductor wires is N and the number of ground wires is $2N+2$ and where N is an integer between 10 and 50.

13. A woven electrical transmission cable according to claim 8 wherein said conductor wires are each separated from each adjacent ground wire by a pair of insulating fiber strands and in which adjacent ground wires are separated from each other by a longitudinally extending insulating fiber strand.

14. A woven electrical transmission cable according to claim 13 wherein the ground wire adjacent each of said selvages is separated from its next adjacent ground wire by a pair of longitudinally extending insulating fiber strands and wherein the adjacent ground wires in the center of the cable are separated by a lesser number of insulating strands than the adjacent ground wires at the edges of the cable.

* * * * *